United States Patent [19]

Dilcher

[11] Patent Number: 4,669,220

[45] Date of Patent: Jun. 2, 1987

[54] SWING-AND-SLIDE DOOR FOR VEHICLES ESPECIALLY RAILROAD PASSENGER VEHICLES

[75] Inventor: Dietmar Dilcher, Vellmar, Fed. Rep. of Germany

[73] Assignee: Firma Gebr. Bode & Co. GmbH, Kassel, Fed. Rep. of Germany

[21] Appl. No.: 845,158

[22] Filed: Mar. 27, 1986

[30] Foreign Application Priority Data

Apr. 1, 1985 [DE] Fed. Rep. of Germany ..... 3511896

[51] Int. Cl.[4] ..... E05D 15/10

[52] U.S. Cl. ..... 49/219

[58] Field of Search ..... 49/219, 218, 209, 216, 49/127

[56] References Cited

U.S. PATENT DOCUMENTS

| | | | |
|---|---|---|---|
| 2,701,394 | 2/1955 | Anderson | 49/218 X |
| 3,994,094 | 11/1976 | Marzocco | 49/218 X |
| 4,495,729 | 1/1985 | Britzke et al. | 49/216 X |
| 4,503,638 | 3/1985 | Schindehutte | 49/218 X |

*Primary Examiner*—Philip C. Kannan

*Attorney, Agent, or Firm*—Sprung Horn Kramer & Woods

[57] ABSTRACT

A swing-and-slide door for vehicles, especially railroad passenger vehicles. The leaf is suspended at the top on a positioning bushing on a supporting rail that extends over the total width of the door. At the bottom of the door a horizontal positioning rail is secured to the leaf. A positioning section slides back and forth mechanically secured in the positioning rail. The securing rail and positioning section are secured to the studs of two cranks. The cranks are fastened vertically separated to the vehicle superstructure by means of horizontal shaft studs and cranks studs that extend parallel to the direction of displacement, are connected by a connecting section, and are driven by a pneumatic cylinder. The door is opened in a sequence of two stages. The leaf is first displaced out of the closed position into a ready-to-slide position and then slid horizontally to the side in that position. The bottom and top of the leaf are mechanically secured during both stages.

9 Claims, 7 Drawing Figures

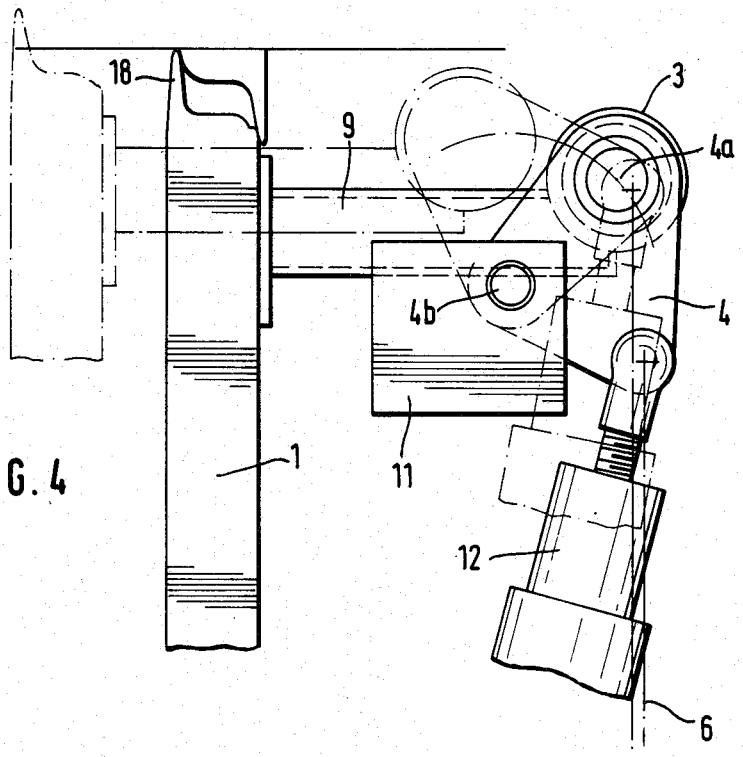
FIG. 4
FIG. 5
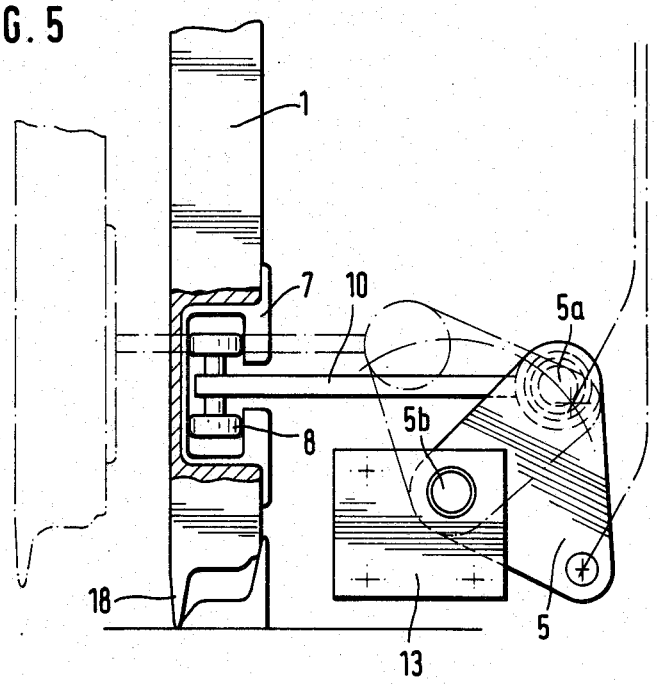

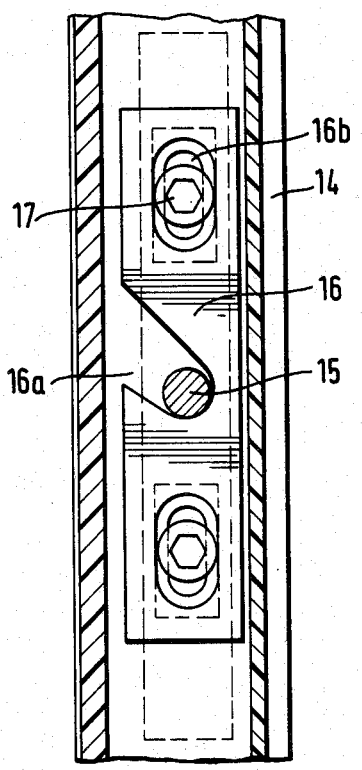
FIG. 7
FIG. 6
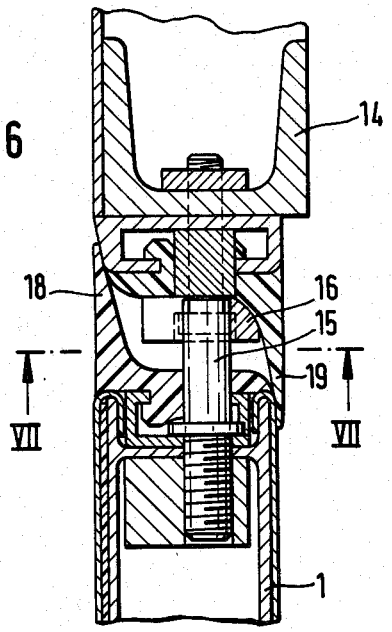

SWING-AND-SLIDE DOOR FOR VEHICLES ESPECIALLY RAILROAD PASSENGER VEHICLES

BACKGROUND OF THE INVENTION

The present invention relates to a swing-and-slide door for vehicles, especially railroad passenger vehicles, with a doorway frame mounted in an opening in the wall of a superstructure and with a door leaf that is displaced outward in an initial stage of motion from a closure position into a ready-to-slide position and then in a second stage of motion slides horizontally to the side along the outside of the superstructure into a fully-open position, whereby the direction of motion that occurs during the initial stage is strictly at a right angle to the direction of sliding that occurs during the second stage, whereby there is a suspension mechanism in the vicinity of the upper edge and a positioning mechanism in the vicinity of the lower edge of the doorway frame inside the superstructure for sliding the leaf horizontally to the side, whereby the suspension mechanism includes a supporting rail that the leaf is suspended on by means of a supporting section that is rigidly fastened to it and that the leaf can slide along, and whereby the suspension mechanism attached to a stud of one crank and the positioning mechanism to a stud of another crank, the cranks being both vertically separated by horizontal shaft studs and the crank studs that extend along the direction of sliding and connected by a connecting section.

A swing-and-slide door of this type is described for example in German No. C 2 003 857. The drawback to the known door is that, although the leaf does remain essentially vertical in the first stage of its opening motion while it is being forced out from the wall of the superstructure as is intended in order to facilitate sliding, its upper edge is not positioned in such a way that a really synchronized and uniform transverse displacement of the suspension and positioning mechanisms will always reliably guide the upper and lower areas of the leaf as a whole out of the closure position into the ready-to-slide position and along the direction of displacement. The lower edge of the leaf of the known swing-and-slide door is, rather, only supported by tracks and only forced tight against the meeting edge by a support at its lower edge as well while it is closed, as well as being simultaneously lifted to some extent to prevent the weight of the leaf from being supported only at the upper edge by the suspension mechanism while the door is closed.

Furthermore, since the leaf of the known swing-and-slide door is suspended on individual rollers from the supporting rail, the leaf must be suspended at several points, or at least at the front and rear edge, and, since the supporting rail must accordingly extend over the total width of the door, it must be mounted outside the doorway frame.

SUMMARY OF THE INVENTION

The object of the present invention is to improve a swing-and-slide door of the type initially described in such a way as to ensure correct positioning of the leaf while the door is open, while it is closed, and during both stages of opening and closing and hence provide definitely defined positioning in every position, whereby the door seals can be applied and removed without any lateral displacements and the leaf will be so precisely designed that it will be reliably secured in supplementary locking mechanisms while it is closing. Thus, the swing-and-slide door in accordance with the invention can be employed in particular in very rapid modern railroad cars, leading to another object — that no positioning components are mounted outside the doorway frame.

This object is attained in accordance with the invention in an improvement wherein the supporting section is a positioning bushing around the supporting rail and is connected to the leaf in the immediate vicinity of the meeting edge of the leaf that is at the rear in relation to the direction of displacement while the door is being opened and the positioning mechanism includes a positioning rail that is rigidly connected to the leaf, that extends parallel to the direction of displacement, and that a positioning section slides back and forth in and establishes a mechanical interlock in a horizontal plane, whereby the positioning section is rigidly fastened to the stud 5*a* of one crank web and is positioned in such a way that, when the door is closed, it supports the leaf in the immediate vicinity of the meeting edge that is forward in relation to the direction of displacement while the door is being opened.

The cranks in one preferred embodiment of the invention can be positioned in such a way that, while the door is being closed, the leaf will simultaneously descend at least in a final extent of the stage of motion out of the ready-to-slide position into the closure position and means for locking are provided on the leaf and on the frame and mutually engage during the descent in such a way as to lock the leaf in the closure position.

The cranks can be connected by an essentially vertical tie rod in such a way as to constitute a four-bar mechanism. The cranks can be connected by a chain drive.

The cranks can be positioned in such a way that the shaft studs will always be below the crank studs when the leaf of the door is in either the closure position or in the ready-to-slide position.

The supporting rail can consist of studs on the upper crank and extending at least over the total width of the door, with crank webs positioned at each end of the supporting rail and pivoting on shaft studs.

The upper crank and the lower crank can each have the same radius. The cranks can be driven by a pneumatic cylinder. The positioning bushing can be connected to a drive mechanism positioned above the supporting rail.

The drive mechanism can be an electromechanical linear drive mechanism with its takeoff section connected to the positioning bushing. Alternatively, the drive mechanism can be a pneumatic cylinder without a piston rod and with its piston connected directly to the positioning bushing.

The positioning section can be a fulcrum slide in the positioning rail.

The positioning section can be a rolling carriage in the positioning rail.

The leaf of the swing-and-slide door in accordance with the invention will move synchronized and uniformly in each stage of its opening and closing motion and will be constantly mechanically secured.

Making the supporting section a positioning bushing will provide the leaf with a guide at that point that can also accept tilting moments in relation to the axes perpendicular to the longitudinal axis of the supporting rail, making it possible to attach the leaf at a point on the supporting section where the supporting rail will not need to extend out beyond the width of the door. The positioning section on the other hand must be positioned in such a way that, as will be described later herein in relation to one embodiment, it can engage a point on the leaf that is essentially diagonally opposite the point of engagement of the supporting section when the door is closed. This is an especially simple way of ensuring reliable and mechanically interlocking positioning of the leaf at only two points, so that the leaf will be securely guided during its whole opening or closing motion and will automatically engage the means of locking when the door is closed.

Some preferred embodiments of the invention will now be described with reference to the attached drawings, wherein

BRIEF DESCRIPTION OF THE DRAWINGS

FIG. 6 is a larger-scale partial section through the vicinity of a locking mechanism in one of the vertical edges of the doorway frame with the leaf of the door against it, and FIG. 7 is a section along the line VII—VII in FIG. 6.

DETAILED DESCRIPTION OF THE PREFERRED EMBODIMENTS

FIGS. 1 to 5 illustrate a swing-and-slide door that closes off an entrance or exit in the wall of a superstructure of a railroad vehicle that is not otherwise illustrated. For simplicity's sake the leaf 1 of the swing-and-slide door is represented as essentially flat, with the result that all the meeting edges of the line in one plane of closure S. The door in accordance with the invention can of course also have other shapes, and in particular be partly or completely curved, in which case the meeting edges of the doorway frame do not necessarily have to be in one plane.

Figure 1:
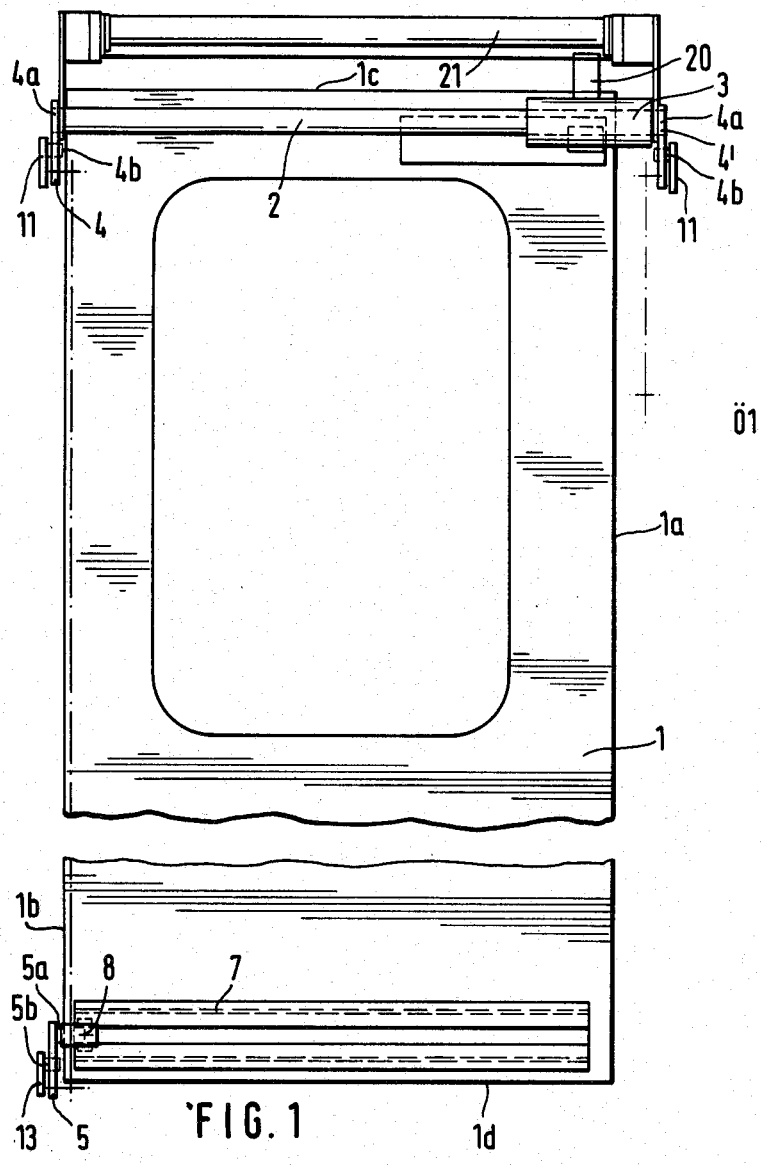
FIG. 1 is a view from inside the superstructure of a swing-and-slide qoor in accordance with the invention.
Figure 3:
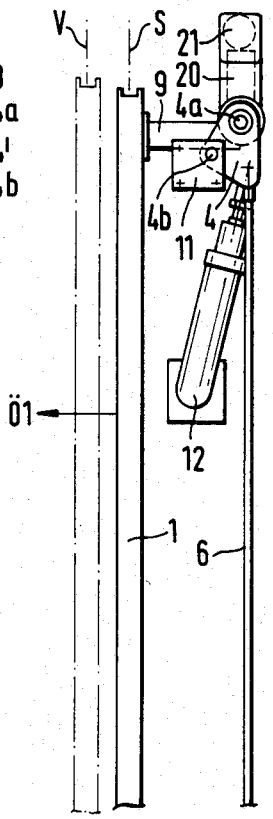
FIG. 3 is a side view of the swing-and-slide door illustrated in FIGS. 1 and 2, FIGS. 4 and 5 are larger-scale details of the areas at the top and bottom in FIG. 3.
Figure 3:
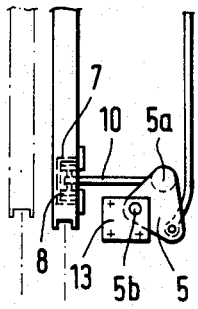
Figure 2:
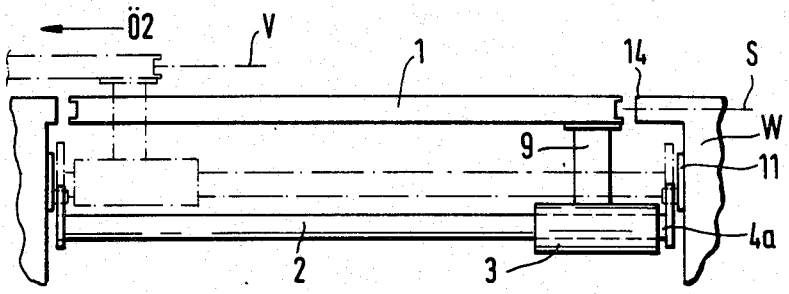
FIG. 2 is a top view of the swing-and-slide door in FIG. 1.

The leaf 1 of the swing-and-slide door illustrated in FIGS. 1 to 3 is attached to the superstructure W, which supports a doorway frame 14, of a railroad vehicle by an upper suspension mechanism 2, 3, and 4 and by a lower positioning mechanism 5, 7, and 8.

The suspension mechanism includes a supporting rail in the form of a round horizontal rod 2 that extends parallel to plane of closure S and is surrounded by a supporting section in the form of a positioning bushing 3 that slides back and forth on round rod 2 and is rigidly fastened by a connector 9 to leaf 1 in the vicinity of its upper edge 1*c* just in front of the right-hand vertical meeting edge 1*a* in FIG. 1. Each end of round rod 2 is rigidly fastened to the crank webs 4 and 4' of a crank that pivots on shaft studs 4*b*. Thus, the crank in question has as it were an extremely prolonged stud that extends over the total width of the door between the two crank webs.

Shaft studs 4*b* are mounted in bearings 11 attached to superstructure W. Crank webs 4 and 4' are pivoted with a pneumatic cylinder 12 that has a piston rod connected to crank web 4.

Leaf 1 has a horizontal positioning rail 7 rigidly mounted at its lower edge 1*d*. A rolling carriage 8 is mechanically secured in and slides back and forth in positioning rail 7 and is connected by a connector 10 to the crank stud 5*a* of a face crank with a crank web 5 and a shaft stud 5*b* that is mounted in a bearing 13 secured to superstructure W. Crank 5 is positioned in such a way that, when the door is closed as illustrated in FIG. 1, rolling carriage 8 engages a point directly behind vertical meeting edge 1*b*, which is on the left in the figure, and is accordingly essentially diagonally opposite the point of connection between positioning bushing 3 and leaf 1 in the vicinity of the upper right corner of the leaf. This ensures uniform contact and tensioning of the door seals when the door is finally closed.

As will be evident from FIG. 1, the crank studs 4*a* and 5*a* and shaft studs 4*b* and 5*b* of both cranks are horizontal and parallel to plane of closure S. Furthermore, since crank webs 4 and 5 are connected by a tie rod 6, both cranks will always be synchronized. Another type of connection, a chain drive for example, can of course be employed instead of a tie rod.

When the swing-and-slide door is closed, leaf 1 will be in the position within plane of closure S represented by the solid lines in FIGS. 2 and 3. The door is opened in a sequence of two stages. In the initial stage leaf 1 is moved out of plane of closure S into a parallel plane of displacement V. This motion is executed due to the pivoting of both cranks 4 and 5, subject to the action of a pneumatic cylinder 12 for example, and all the components of the motion are exclusively within a vertical plane that is perpendicular to plane of closure S. Leaf 1 moves on the whole in the direction indicated by arrow 01, with its motion dictated by the radii and angles of the cranks in their initial and final limiting positions. The leaf 1 in the embodiment illustrated in FIGS. 1 to 5 is, when it is within plane of displacement V, slightly elevated in relation to its position within plane of closure S.

Once it is within plane of displacement V, leaf 1 can be slid horizontally and to the side in the direction indicated by arrow 02, completely freeing the entrance or exit opening.

The door is opened by a linear drive mechanism 21, an electromechanical linear drive or a pneumatic cylinder with no piston rod for example, positioned above the entrance or exit opening and with its moving take-out section connected by a connector 20 to supporting section 3, which slides along supporting rail 12 when the leaf moves in the direction indicated by arrow 02.

The leaf is guided at the bottom during this motion by the rolling carriage 8 in positioning rail 7.

The door is closed by a similar sequence of motions in the opposite direction, with leaf 1 being displaced back out of plane of displacement V and into plane of closure S again and simultaneously lowered during the last stage. The lowering motion makes it possible for leaf 1 to engage locking mechanisms in the form of pins and recesses mounted on doorway frame 14.

Locking mechanisms of this type are especially intended to ensure the secure seating of a relatively flexible leaf in the closing terminal position.

The locking mechanisms in the embodiment described herein will be evident from FIGS. 6 and 7. Flat locking strips 16 are secured in the vertical edges of doorway frame 14 with screws 17, which, since they extend through slots 16*b* in locking strips 16, allow precise adjustment of the height of the strips. On the outward edge of each locking strip 16 is an upward sloping slot-like recess 16*a*, in which a locking bolt 15 that is, as will be evident from FIG. 6, positioned on leaf 1, can engage.

As will be especially evident from FIG. 6, leaf 1 is surrounded by a continuous rubber seal 18 and doorway frame 14 by a continuous rubber seal 19 to ensure a tight seal between the leaf and the frame and simultaneously mask the locking mechanism on both sides. The seal around leaf 1 is also illustrated in FIGS. 4 and 5, but is left out of FIGS. 1 to 3 for simplicity's sake.

It will be appreciated that the instant specification and claims are set forth by way of illustration and not limitation, and that various modifications and changes may be made without departing from the spirit and scope of the present invention.

What is claimed is:

1. In a swing-and-slide door for vehicles, especially railroad passenger vehicles, having a doorway frame mounted in an opening in the wall of a superstructure, a door leaf, means mounting the door leaf in the frame such that the door leaf is displaced outward in an initial stage of motion from a closure position into a ready-to-slide position and then in a second stage of motion slide horizontally to the side along the outside of the superstructure into a fully-open position, wherein the direction of motion that occurs during the initial stage is strictly at a right angle to the direction of slide that occurs during the second stage, including a suspension mechanism in the vicinity of an upper edge and a positioning mechanism in the vicinity of the lower edge of the doorway frame inside the superstructure for sliding the leaf horizontally to the side, wherein the suspension mechanism includes a supporting rail, a supporting section suspending the leaf on the supporting rail for sliding movement, and wherein the suspension mechanism is attached to a stud of one crank and the positioning mechanism is attached to a stud of another crank, the cranks being both vertically separated by horizontal shaft studs and the crank studs that extend along the direction of slide and connected by a connecting section, the improvement wherein the supporting section comprises a positioning bushing around the supporting rail and connected to the leaf in the immediate vicinity of a meeting edge of the leaf that is at the rear in relation to the directio,n of displacement while the door is being opened and the positioning mechanism includes a positioning rail rigidiy connected to the leaf and that extends parallel to the direction of displacement, a positioning section slides back and forth in and establishing a mechanical interlock in a horizontal plane, wherein the positioning section is rigidly fastened to the stud of said another crank web and is positioned such that, when the door is closed, it supports the leaf in the immediate vicinity of the meeting edge that is forward in relation to the direction of displacement while the door is being opened.

2. The swing-and-slide door as in claim 1, wherein the cranks are positioned such that, while the door is being closed, the leaf will simultaneously descend at least in a final extent of the stage of motion out of the ready-to-slide position into the closure position and further comprising locking means on the leaf and on the frame for mutually engaging during the descent to lock the leaf in the closure position.

3. The swing-and-slide door as in claim 1, comprising an essentially vertical tie rod connecting the cranks to form a four-bar mechanism.

4. The swing-and-slide door as in claim 1, wherein the cranks are positioned such that the shaft studs will always be below the crank studs when the leaf of the door is in either the closure position or in the ready-to-slide position.

5. The swing-and-slide door as in claim 1, wherein the supporting rail comprises the studs on the upper crank and the supporting rail extends at least over the total width of the door and wherein crank webs are positioned at each end of the supporting rail and pivoting on the shaft studs.

6. The swing-and-slide door as in claim 1, wherein the upper crank and the lower crank each have the same radius.

7. The swing-and-slide door as in claim 1, further comrising a pneumatic cylinder with a piston rod connected to the cranks for driving the cranks.

8. The swing-and slide door as in claim 1, further comprising a drive mechanism connected to the positioning bushing and positioned above the supporting rail.

9. The swing-and-slide door as in claim 1, wherein the positioning section comprises a rolling carriage in the positioning rail.

* * * * *